US009664453B2

(12) United States Patent
Huang

(10) Patent No.: US 9,664,453 B2
(45) Date of Patent: May 30, 2017

(54) ALUMINUM PIPE AND HEAT PIPE PACKAGE AND ITS PACKAGING METHOD

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 247 days.

(21) Appl. No.: 14/609,424

(22) Filed: Jan. 29, 2015

(65) Prior Publication Data

US 2016/0146544 A1 May 26, 2016

(30) Foreign Application Priority Data

Nov. 21, 2014 (CN) ..... 2014 1 0671359

(51) Int. Cl.
*F28D 15/00* (2006.01)
*F28D 15/02* (2006.01)

(52) U.S. Cl.
CPC ..... *F28D 15/02* (2013.01); *F28D 15/0275* (2013.01)

(58) Field of Classification Search
CPC .. F28D 15/02; F28D 15/0275; F28D 15/0283; F01N 2470/26; F01N 2470/28; F16L 13/14; F16L 13/141; B21D 39/04; B21D 41/405; H01L 23/427; H05K 7/20336; H05K 7/20663
USPC ..... 165/104.21
See application file for complete search history.

(56) References Cited

U.S. PATENT DOCUMENTS 4,186,586 A * 2/1980 Takamura ..... B21C 23/007 29/423
2010/0288822 A1* 11/2010 Chung ..... B21C 37/122 228/145
2012/0175097 A1* 7/2012 Chen ..... B21D 39/04 165/177
2013/0175007 A1* 7/2013 Lin ..... F28D 15/02 165/104.26

FOREIGN PATENT DOCUMENTS

JP 2003290849 A * 10/2003 ..... B21D 41/04
TW M345223 11/2008
TW I429489 B 3/2014

* cited by examiner

*Primary Examiner* — Davis Hwu
(74) *Attorney, Agent, or Firm* — Pai Patent & Trademark Law Firm; Chao-Chang David Pai

(57) ABSTRACT

An aluminum pipe and heat pipe package is formed by inserting a heat pipe into a hollow aluminum pipe, and then processing the combination of the heat pipe and hollow aluminum pipe through a series of extrusion molding steps. The extrusion molding steps are performed by means of opposing top and bottom extrusion dies and opposing left and right necking dies to reduce the gap between the hollow aluminum pipe and the heat pipe. Consequently, the hollow aluminum pipe and the heat pipe are peripherally tightly fitted together, and the two opposite open ends of the hollow aluminum pipe are completely blocked up.

2 Claims, 6 Drawing Sheets

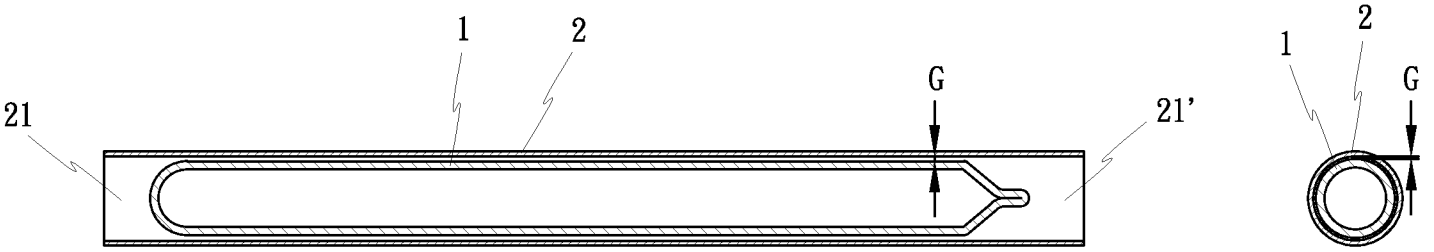
FIG. 4
FIG. 5
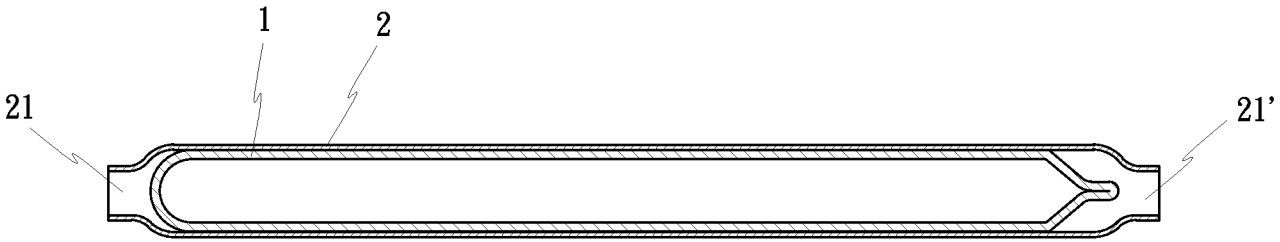
FIG. 6

ALUMINUM PIPE AND HEAT PIPE PACKAGE AND ITS PACKAGING METHOD

BACKGROUND OF THE INVENTION (a) Field of the Invention

The present invention relates to heat pipe technology, and more particularly to an aluminum pipe and heat pipe package made through a series of extrusion molding steps.

(b) Description of the Prior Art

A heat pipe is a closed evaporator-condenser system consisting of a sealed, hollow tube whose inside walls are lined with a capillary structure or wick. It combines both thermal conductivity and phase transition to efficiently manage the transfer of heat between two solid interfaces. Conventional heat pipes are made from copper. Due to the effects of the material properties, the copper body of a heat pipe is prone to burst in the casting mold in high-temperature environments, and brass body is prone to burst at a high temperature of die casting. An aluminum pipe can be wrapped about a heat pipe to enhance the overall structural strength, avoiding burst under a high temperature environment. Taiwan Patent M345223 discloses a sheathed flat heat pipe, which comprises a flat heat pipe, and a flat sleeve wrapped about the flat heat pipe in such a manner that the evaporator end of the flat heat pipe is exposed to the outside of the flat sleeve. Further, in Taiwan Patent 1429489, a heat pipe is inserted into a hollow metal pipe (made of aluminum), and then the hollow metal pipe is stretched to extend its length and to reduce its diameter, and thus, the hollow metal pipe is tightly wrapped about the heat pipe to form a metal-wrapped heat pipe.

According to the cited 1429489 design, the hollow metal pipe is stretched to extend its length and to reduce its diameter, however, this method needs to employ a secondary machining process to block up the two opposite open ends of the hollow metal pipe in order to completely wrap the heat pipe inside the hollow metal pipe.

SUMMARY OF THE INVENTION

The present invention has been accomplished under the circumstances in view. It is therefore the main object of the present invention to provide an aluminum pipe and heat pipe package, which is formed by inserting a heat pipe into a hollow aluminum pipe, and then processing the combination of the heat pipe and hollow aluminum pipe through a series of extrusion molding steps by means of opposing top and bottom extrusion dies and opposing left and right necking dies to reduce the gap between the hollow aluminum pipe and the heat pipe, and to have the hollow aluminum pipe and the heat pipe to be peripherally tightly fitted together, and the two opposite open ends of the hollow aluminum pipe to be completely blocked up. Thus, the aluminum pipe and heat pipe package can easily be made without a secondary machining process, saving the manufacturing procedure and reducing the manufacturing cost.

BRIEF DESCRIPTION OF THE DRAWINGS

FIG. 4 is a longitudinal sectional view illustrating the heat pipe inserted into the hollow aluminum pipe in accordance with the present invention.

FIG. 5 is a cross sectional view of the assembly of FIG. 4.

FIG. 6 is a schematic drawing illustrating the combination of the hollow aluminum pipe and heat pipe after a primary processing through a first stage extrusion molding step.

DETAILED DESCRIPTION OF THE PREFERRED EMBODIMENTS

Figure 1:
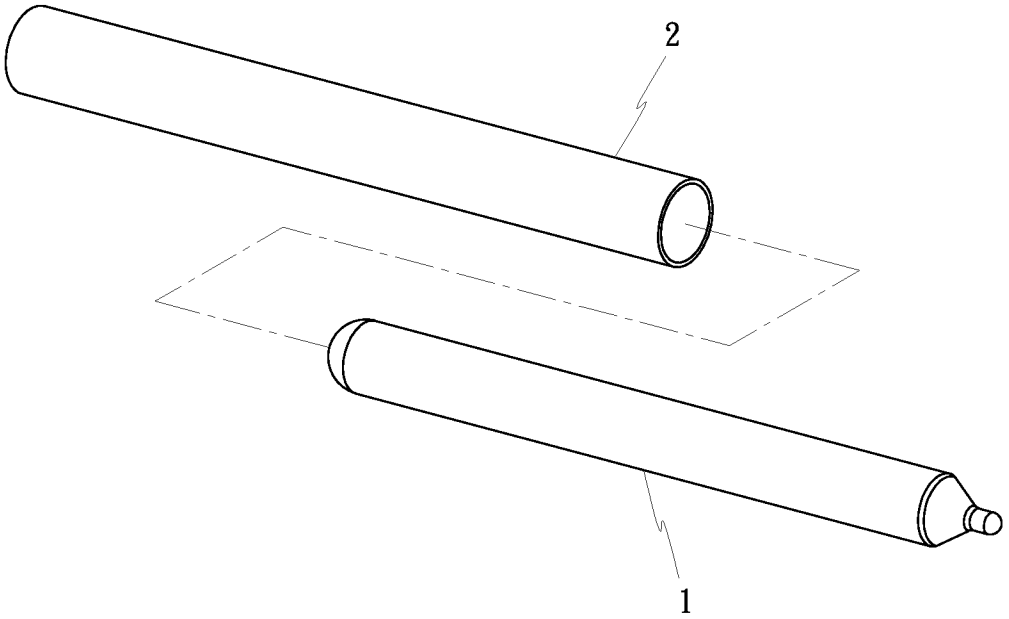
FIG. 1 is an exploded view of a hollow aluminum pipe and a heat pipe in accordance with the present invention.
Figure 2:
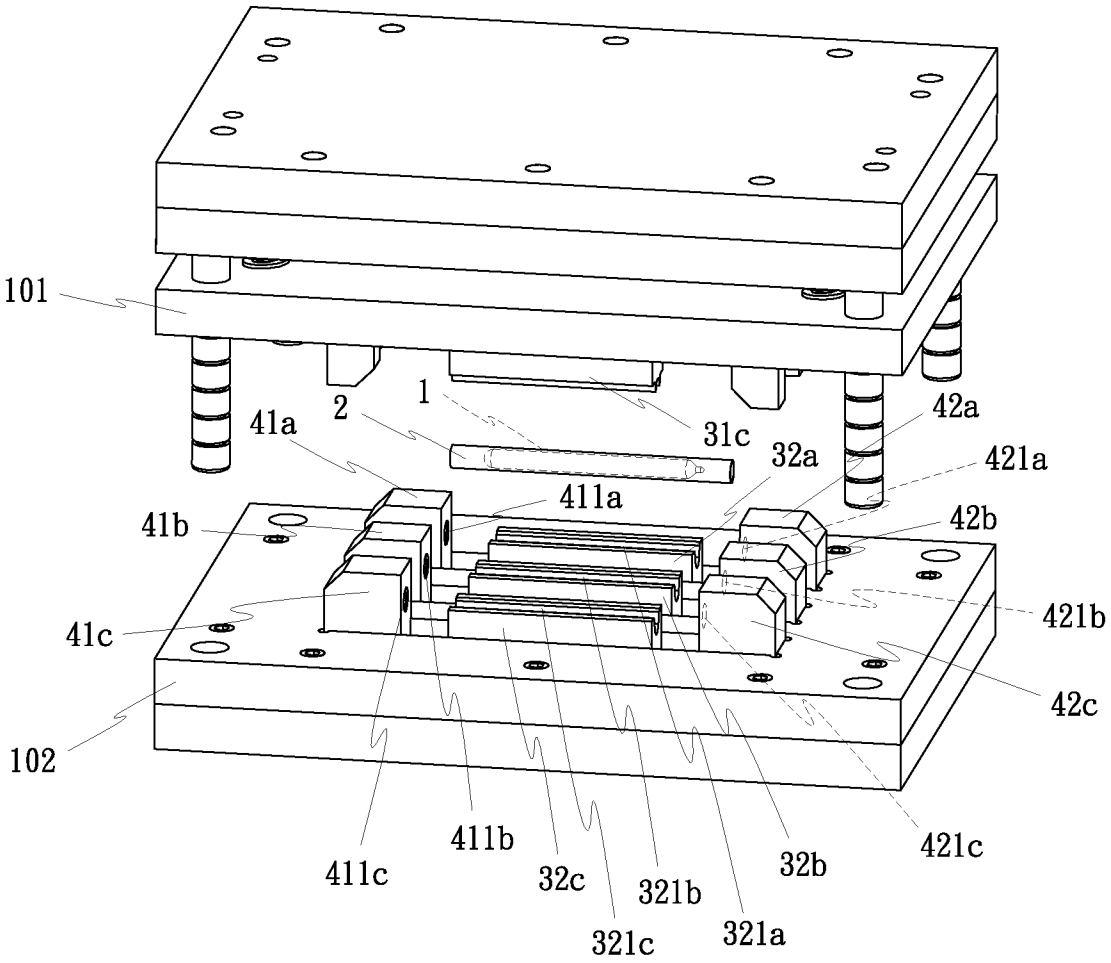
FIG. 2 is a schematic drawing illustrating the arrangement of opposing top and bottom extrusion dies and opposing left and right necking dies in opposing top and bottom molds in accordance with the present invention.
Figure 3:
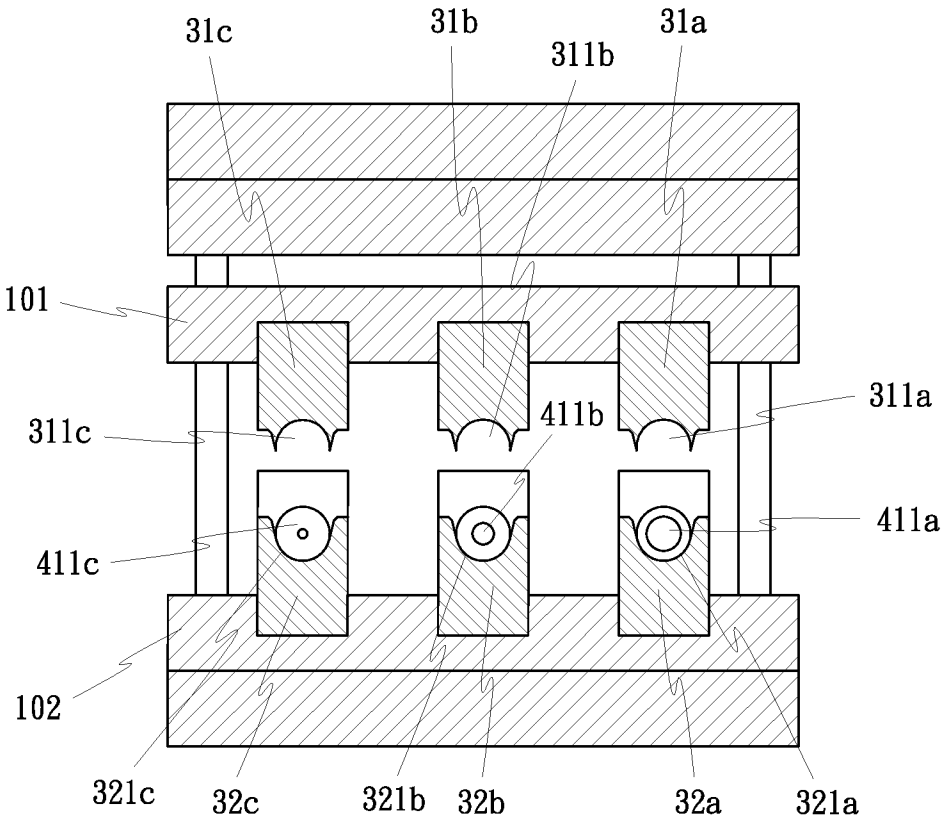
FIG. 3 is a sectional assembly view of FIG. 2.

FIGS. 1-3 illustrate an aluminum pipe and heat pipe package and its packaging method in accordance with the present invention. At first, insert a heat pipe 1 into a hollow aluminum pipe 2, and then the combination of the heat pipe 1 and hollow aluminum pipe 2 is processed through a series of extrusion molding steps. The extrusion molding steps are performed by means of opposing top and bottom extrusion dies 31*a*,32*a* (31*b*,32*b*; 31*c*,32*c*) and opposing left and right necking dies 41*a*,42*a* (41*b*,42*b*; 41*c*,42*c*) to reduce the gap G between the hollow aluminum pipe 2 and the heat pipe 1 (see FIG. 4 and FIG. 5). This will cause the hollow aluminum pipe 2 and the heat pipe 1 to be peripherally tightly fitted together, and the two opposite open ends 21,21' of the hollow aluminum pipe 2 to be completely blocked up. Consequently, the hollow aluminum pipe 2 and the heat pipe 1 are packaged together.

In the aforesaid opposing top and bottom extrusion dies 31*a*, 32*a* (31*b*,32*b*; 31*c*,32*c*) and opposing left and right necking dies 41*a*,42*a* (41*b*,42*b*; 41*c*,42*c*):

The die cavities 311*a*,311*b*,311*c* of the top extrusion dies 31*a*,31*b*,31*c*, as shown in FIG. 3, are proportionally decreased in size in the order that 311*a*>311*b*>311*c*, and the die cavities 321*a*,321*b*,321*c* of the bottom extrusion dies 32*a*, 32*b*, 32*c* are similarly designed, i.e., 321*a*>321*b*>321*c*.

The necking die cavities 411*a*,411*b*,411*c* of the left necking dies 41*a*,41*b*,41*c*, as shown in FIG. 2, are proportionally decreased in size, i.e., 411*a*>411*b*>411*c*, and the necking die cavities 421*a*,421*b*,421*c* of the right necking dies 42*a*, 42*b*, 42*c* are similarly designed, i.e., 421*a*>421*b*>421*c*.

Figure 7:
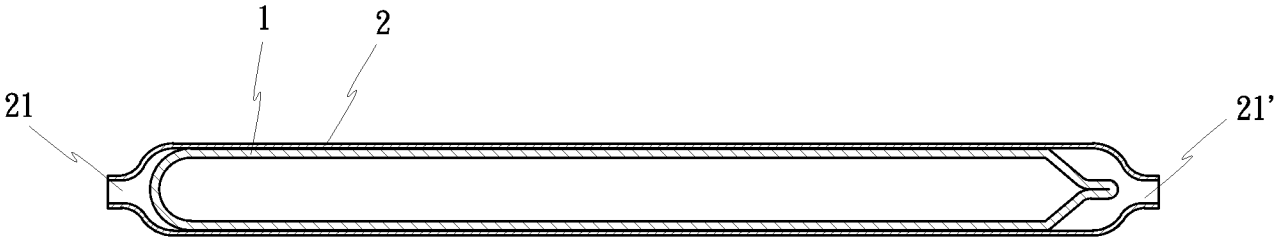
FIG. 7 is a schematic drawing illustrating the combination of the hollow aluminum pipe and heat pipe after a secondary processing through a second stage extrusion molding step.
Figure 8:
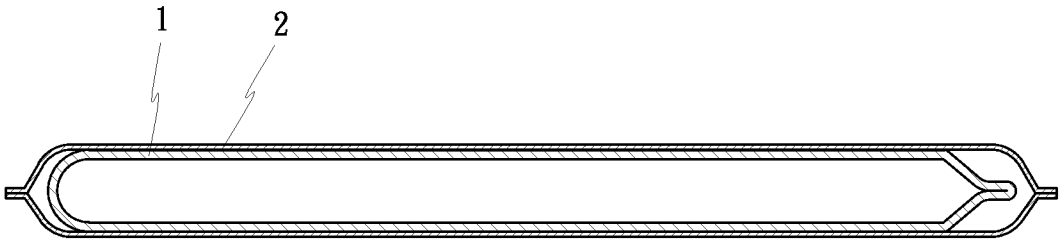
FIG. 8 is a schematic drawing illustrating the combination of the hollow aluminum pipe and heat pipe processed after a third processing through a third stage extrusion molding step.
Figure 9:
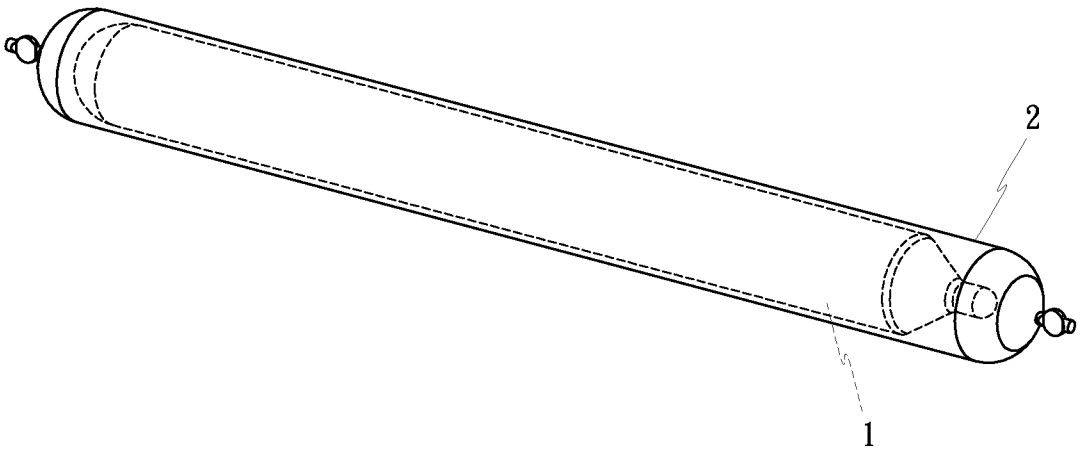
FIG. 9 is a perspective view of an aluminum pipe and heat pipe package.

The opposing top and bottom extrusion dies 31*a*, 32*a* (31*b*,32*b*; 31*c*,32*c*) are respectively fixedly mounted at opposing top and bottom molds 101,102, and the opposing left and right necking dies 41*a*,42*a* (41*b*,42*b*; 41*c*,42*c*) are respectively fixedly mounted at opposing top and bottom molds 101,102 at two opposite lateral sides relative to the respective top and bottom extrusion dies 31*a*, 32*a* (31*b*,32*b*; 31*c*,32*c*). After insertion of the heat pipe 1 into the hollow aluminum pipe 2, the combination of the heat pipe 1 and hollow aluminum pipe 2 is processed through a series of extrusion molding steps by means of opposing top and bottom extrusion dies 31*a*,32*a* (31*b*,32*b*; 31*c*,32*c*) and opposing left and right necking dies 41*a*,42*a* (41*b*,42*b*; 41*c*,42*c*) to reduce the gap G between the hollow aluminum pipe 2 and the heat pipe 1, causing the hollow aluminum pipe 2 and the heat pipe 1 to be peripherally tightly fitted together, and the two opposite open ends 21,21' of the hollow aluminum pipe 2 to be completely blocked up (see FIGS. 6-8), and thus, the hollow aluminum pipe 2 and the heat pipe 1 are packaged together.

In the processing, the combination of the heat pipe 1 and hollow aluminum pipe 2 is primarily processed through a first stage extrusion molding step by means of the first top and bottom extrusion dies 31*a*,32*a* and the first left and right necking dies 41*a*,42*a* to reduce a part of the gap G between the hollow aluminum pipe 2 and the heat pipe 1 and to simultaneously contract the open ends 21,21' of the hollow aluminum pipe 2 for the first time (see FIG. 6). Thereafter, the primarily processed combination of the heat pipe 1 and hollow aluminum pipe 2 is then processed through a second stage extrusion molding step by means of the second top and bottom extrusion dies 31*b*,32*b* and the second left and right necking dies 41*b*,42*b* to further reduce the gap G between the hollow aluminum pipe 2 and the heat pipe 1 and to simultaneously contract the open ends 21,21' of the hollow aluminum pipe 2 for a second time (see FIG. 7). Thereafter, the secondarily processed combination of the heat pipe 1 and hollow aluminum pipe 2 is then processed through a third stage extrusion molding step by means of the third top and bottom extrusion dies 31*c*,32*c* and the third left and right necking dies 41*c*,42*c* to further reduce the gap G between the hollow aluminum pipe 2 and the heat pipe 1 and to simultaneously contract the open ends 21,21' of the hollow aluminum pipe 2 again (see FIG. 8), causing the hollow aluminum pipe 2 and the heat pipe 1 to be peripherally tightly fitted together, and the two opposite open ends 21,21' of the hollow aluminum pipe 2 to be completely blocked up, and thus, the hollow aluminum pipe 2 and the heat pipe 1 are combined into a package.

In conclusion, the invention enables the combination of the heat pipe 1 and hollow aluminum pipe 2 to be processed through a series of extrusion molding steps by means of multiple sets of opposing top and bottom extrusion dies and multiple sets of opposing left and right necking dies to reduce the gap G between the hollow aluminum pipe 2 and the heat pipe 1, causing the hollow aluminum pipe 2 and the heat pipe 1 to be peripherally tightly fitted together, and the two opposite open ends 21,21' of the hollow aluminum pipe 2 to be completely blocked up, and thus, the hollow aluminum pipe 2 and the heat pipe 1 are packaged together. In this embodiment, the combination of the heat pipe and hollow aluminum pipe is processed through three extrusion molding steps. However, the number of extrusion molding steps can be increased or reduced according to actual requirements without departing from the spirit and scope of the invention.

What is claimed is:

1. An aluminum pipe and heat pipe packaging method, comprising the steps of:

a) inserting a heat pipe into a hollow aluminum pipe to obtain a combination having a gap between the heat pipe and the hollow aluminum pipe with two opposite open ends;

b) processing the combination of said heat pipe and said hollow aluminum pipe through a series of extrusion molding steps, each extrusion molding step using a pair of opposing top and bottom extrusion dies and a pair of opposing left and right necking dies to reduce the gap between said hollow aluminum pipe and said heat pipe and simultaneously contract the two opposite open ends of said hollow aluminum pipe, wherein said opposing top and bottom extrusion dies have die cavities thereof proportionally decreased in size and said opposing left and right necking dies have necking die cavities thereof proportionally decreased in size from one extrusion molding step to the next, whereby upon completion of the series of extrusion molding steps, said hollow aluminum pipe and said heat pipe are peripherally fitted together, and the two opposite open ends of said hollow aluminum pipe are completely blocked up.

2. The aluminum pipe and heat pipe packaging method as claimed in claim 1, wherein said opposing top and bottom extrusion dies are respectively fixedly mounted at opposing top and bottom molds; said opposing left and right necking dies are respectively fixedly mounted at said opposing top and bottom molds at two opposite lateral sides relative to the respective said top and bottom extrusion dies.

* * * * *